US007124925B2

(12) United States Patent
Ishizaki

(10) Patent No.: US 7,124,925 B2
(45) Date of Patent: Oct. 24, 2006

(54) STAPLER

(75) Inventor: Kunio Ishizaki, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 10/500,808

(22) PCT Filed: Jan. 14, 2003

(86) PCT No.: PCT/JP03/00202

§ 371 (c)(1),
(2), (4) Date: Jul. 7, 2004

(87) PCT Pub. No.: WO2004/058463

PCT Pub. Date: Jul. 15, 2004

(65) Prior Publication Data

US 2005/0077338 A1 Apr. 14, 2005

(30) Foreign Application Priority Data

Jan. 11, 2002 (JP) ..... 2002-005055

(51) Int. Cl.
*B25C 7/00* (2006.01)
*B25C 5/15* (2006.01)

(52) U.S. Cl. ..... 227/155; 227/131; 227/154

(58) Field of Classification Search ..... 227/82, 227/87, 89, 131, 154, 155
See application file for complete search history.

(56) References Cited

U.S. PATENT DOCUMENTS 4,844,319 A * 7/1989 Kurosawa ..... 227/79
5,004,142 A * 4/1991 Olesen ..... 227/155
5,009,355 A * 4/1991 Akizawa et al. ..... 227/114
5,029,745 A * 7/1991 Akizawa et al. ..... 227/155
5,385,287 A * 1/1995 Scheuten ..... 227/155
5,413,266 A * 5/1995 Jairam ..... 227/129
6,036,074 A * 3/2000 Manabe ..... 227/155
6,641,024 B1 * 11/2003 Sato et al. ..... 227/155

FOREIGN PATENT DOCUMENTS

| | | |
|---|---|---|
| EP | 0 838 310 A2 | 8/2000 |
| JP | 64-23374 | 2/1989 |
| JP | 1-101779 | 7/1989 |
| JP | 3-36779 | 4/1991 |
| JP | 3-503510 | 8/1991 |
| JP | 2000-86069 | 3/2000 |
| JP | 10-118950 | 12/2000 |

* cited by examiner

*Primary Examiner*—Stephen F. Gerrity
*Assistant Examiner*—Nathaniel Chukwurah
(74) *Attorney, Agent, or Firm*—Chapman and Cutler LLP

(57) ABSTRACT

A stapler capable of avoiding defective clinching and buckling of legs even if the stapler is of a vertically-separated type in which a driver unit and a clincher unit are separated vertically is disclosed. This stapler is provided with clincher members (133 and 134) for clinching legs of a staple driven out by a driver and holders (131 and 132) which hold the clincher members (133 and 134). Also, in this stapler, guide surfaces (131*b* and 132*b*) for guiding tips of the legs of the staple toward the clincher members (133 and 134) are formed on upper surface portions of the holders (131 and 132), and the holders (131 and 132) are movable in a direction perpendicular to a surface which includes a direction that the legs of the staple are clinched.

16 Claims, 6 Drawing Sheets

STAPLER

TECHNICAL FIELD

The present invention relates to a stapler for binding a bundle of sheets or the like, and more specifically, to a stapler comprising a clincher for clinching legs of a staple driven out by a driver and a holder for holding the clincher.

BACKGROUND ART

Heretofore, there has been known a stapler comprising a driver for driving out a staple by reciprocal movements thereof and a clincher for clinching legs of the staple driven out by the driver.

Such stapler has, as shown in FIGS. 9 and 10, a pair of clincher members 3 and 4 which are attached rotatably between a pair of clincher holders 1 and 2. As shown in FIG. 11, a pair of inwardly slanted guide surface portions 1*a* and 2*a* is formed on upper surface portions of the clincher holders 1 and 2, respectively. These guide surfaces 1*a* and 2*a* are adapted for guiding tips of the legs of the driven-out staple onto the clincher members 3 and 4. In more detail, these guide surfaces guide the tips of the legs of the staple such that the legs of the staple can be clinched even if the tips of the legs of the staple are deviated from a position of the clincher members 3 and 4 when the staple is driven out. In other words, there is provided tolerance so as to carry out clinching of the legs of the staple even when a center axis of the driver is deviated from the position of the clincher members 3 and 4.

However, there has been a problem that if a deformation load is applied on only one of the legs of the staple, it is buckled. Particularly, alignment of the driver is difficult in a separate type electric stapler in which a driver unit and a clincher unit are separated vertically from each other, so that the problem mentioned above is likely to occur.

DISCLOSURE OF INVENTION

The present invention has been made in view of the problem of the above-described prior art, and therefore, an object of the present invention is to provide a stapler capable of avoiding defective clinching and buckling of legs even if the stapler is of a vertically-separated type in which a driver unit and a clincher unit are separated vertically.

To accomplish the above-mentioned object, a stapler according to the present invention comprises a clincher unit having a clincher for clinching legs of a staple driven out by a driver and a holder which holds the clincher, the holder being formed with guide surfaces which are slanted for guiding tips of the legs of the staple toward the clincher, characterized in that the holder is movable with respect to the clincher unit.

In one embodiment, the stapler further comprises a driver unit having the driver, and the driver unit and the clincher unit are vertically separated from each other.

The clincher has a pair of clincher members disposed rotatable relative to the holder and in such a manner that positions of their rotating surface are deviated from each other, and a partition plate is disposed between the clincher members.

The clincher unit has, in one embodiment, a clincher unit box of which a side opposing the driver is opened. The holder is disposed movable in the clincher unit box. Biasing members are disposed between an one-side wall of the holder and an one-side wall of the clincher unit box opposing the one-side wall of the holder and between an another-wall of the holder and an another-wall of the clincher unit box opposing the another-wall of the holder to bias the holder in directions pressing toward each other.

In one embodiment, the biasing members are wave springs.

BEST MODE FOR CARRYING OUT THE INVENTION

Hereinafter, an embodiment of a stapler according to the present invention will be described in detail on the basis of drawings.

Figure 1:
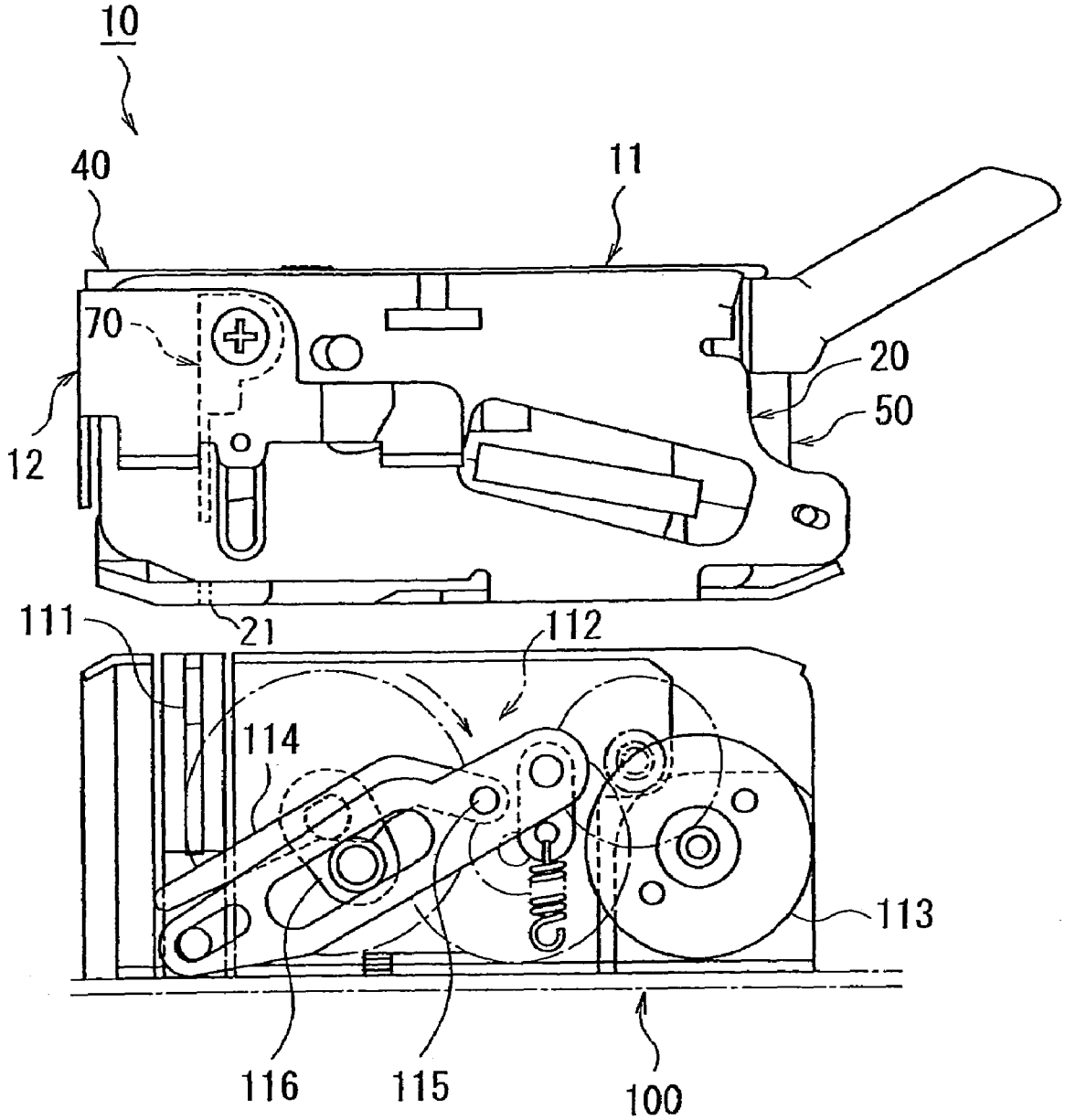
FIG. 1 is an explanatory view schematically showing an entire structure of a stapler according to the present invention.

In FIG. 1, a reference numeral 10 denotes an electric stapler which is of a vertically-separated type, and this stapler 10 comprises a driver unit 11 and a clincher unit 100 disposed below the driver unit 11. The stapler 10 is attached to a copying machine or the like, for example.

The driver unit 11 has a magazine 40 fitted inside of a frame 20, a cartridge 50 which is detachably attached in the magazine 40 and in which sheets of staples (not shown) are stacked and stored, and a driver 70 pivotally mounted to an outer frame 12, and so on. The outer frame 12 retains the driver unit 11 as being movable upwardly and downwardly, and at the same time, fixed to a frame of a body of a post-processing device which is not shown, such as a copying machine. More specifically, the driver unit 11 is vertically movably supported by the body frame by the outer frame 12.

In addition, it is configured that a clinch unit box 111 which will be described later pushes the driver unit 11 up with respect to the outer frame 12, and thereby a tip of the driver 70 is adapted to protrude downwardly from a driving out portion 21 to drive out a staple (not shown) from the driving out portion 21.

The clincher unit 100 includes the clincher unit box 111 provided upwardly and downwardly movable, an up-and-down mechanism 112 for moving the clincher unit box 111 upwardly and downwardly, and a motor 113 for driving the up-and-down mechanism 112, and so on. A reference numeral 114 denotes a clincher arm for rotating clincher members 133 and 134, and this clincher arm 114 is configured to rotate around a shaft 115 as the center. The rotation of the clincher arm 114 is carried out by rotation of a cam 116.

Figure 2:
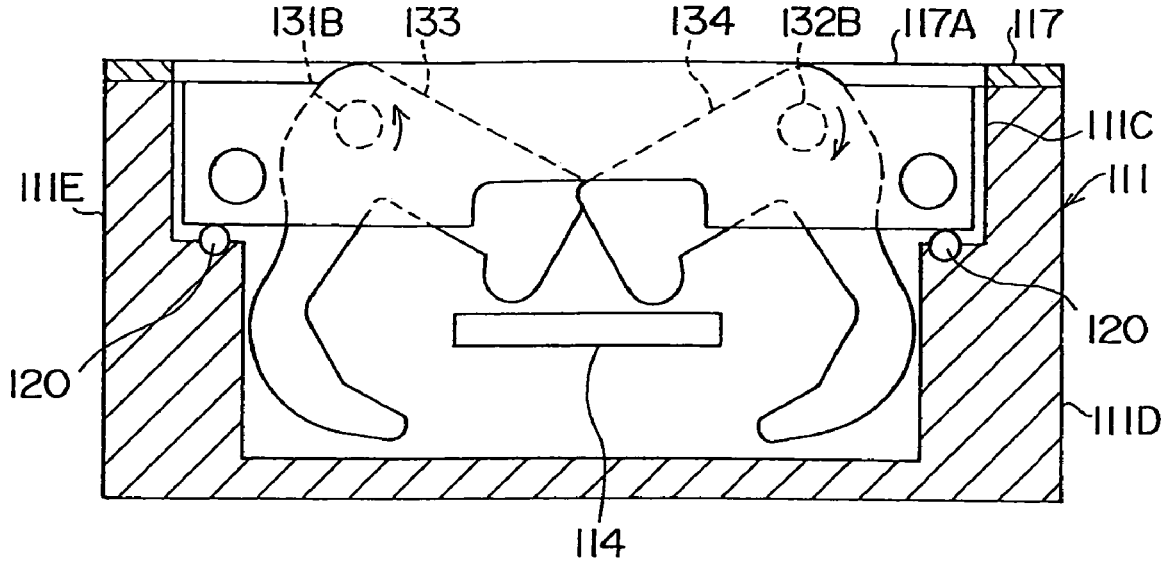
FIG. 2 is a longitudinal sectional view of a clincher unit box in which a holder is mounted.
Figure 3:
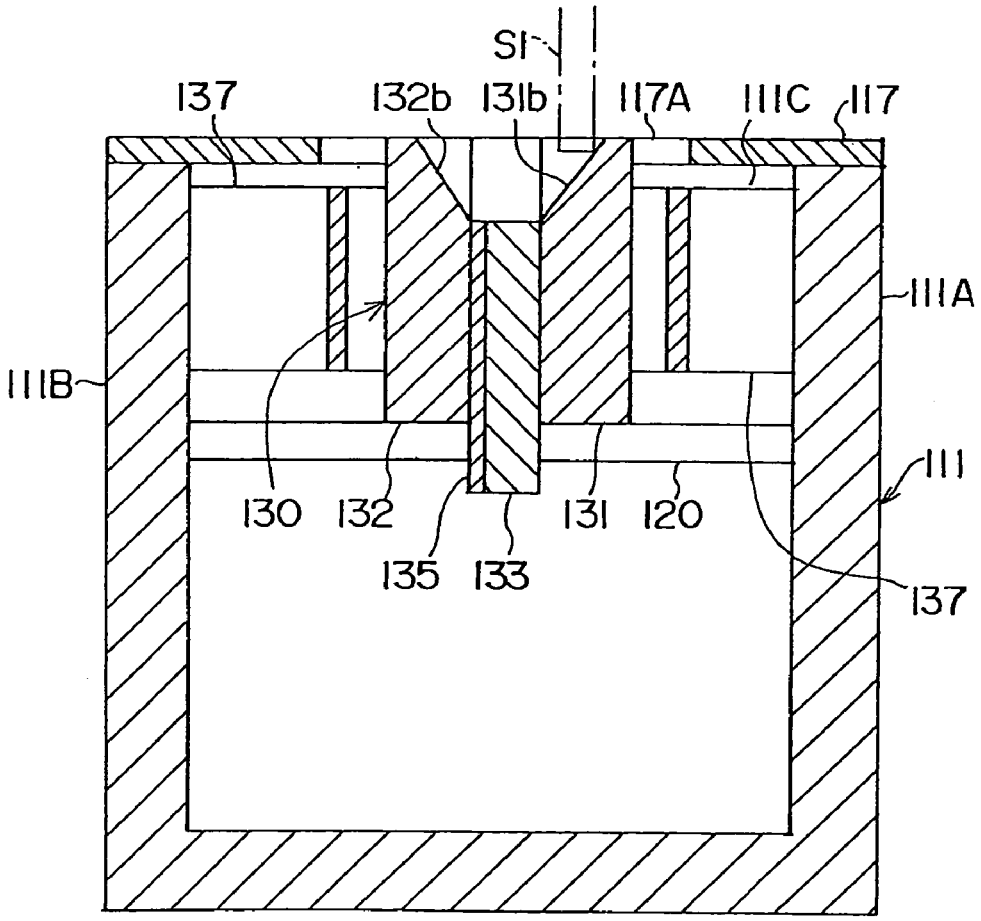
FIG. 3 is a transverse sectional view of the clincher unit box in which the holder is mounted.
Figure 4:
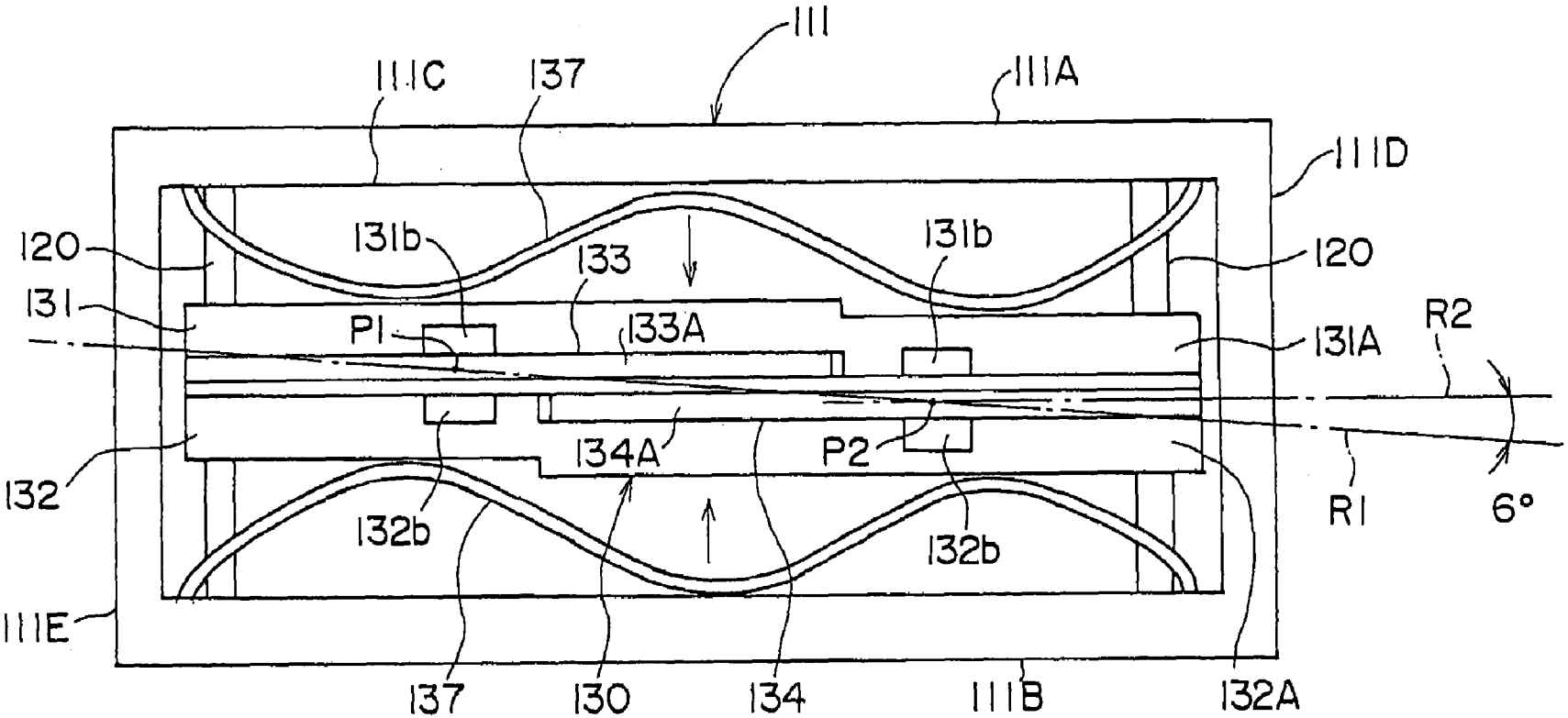
FIG. 4 is a plain view of the clincher unit box in which the holder is mounted.

As shown in FIG. 2 to FIG. 4, the clincher unit box 111 is opened at its upper part, and has side walls 111A and 111B provided at front and rear (right and left in FIG. 3) and side walls 111D and 111E provided at right and left. Between the side walls 111A and 111B and under the opening 111C, there are attached shafts 120 and 120 at positions where separated from each other at a predetermined distance. A table 117 (omitted in FIG. 4) is attached to the opening 111C, and a center part of the table 117 is formed with an opening 117A.

Inside of the clincher unit box 111, there is mounted a holder 130 on the shafts 120 and 120 and at a position facing the opening 117A of the table 117, and the holder 130 is movable freely in an axial direction by sliding on the shafts 120 and 120. The holder 130 is adapted to be capable of being inclined with respect to a straight line R2 which will be described later.

Figure 5:
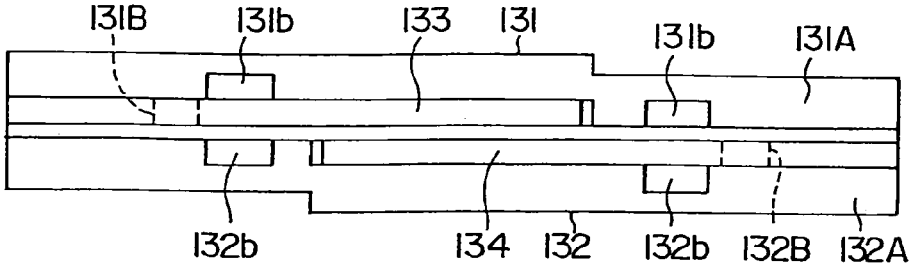
FIG. 5 is a plain view of the holder attached with a clincher.
Figure 6:
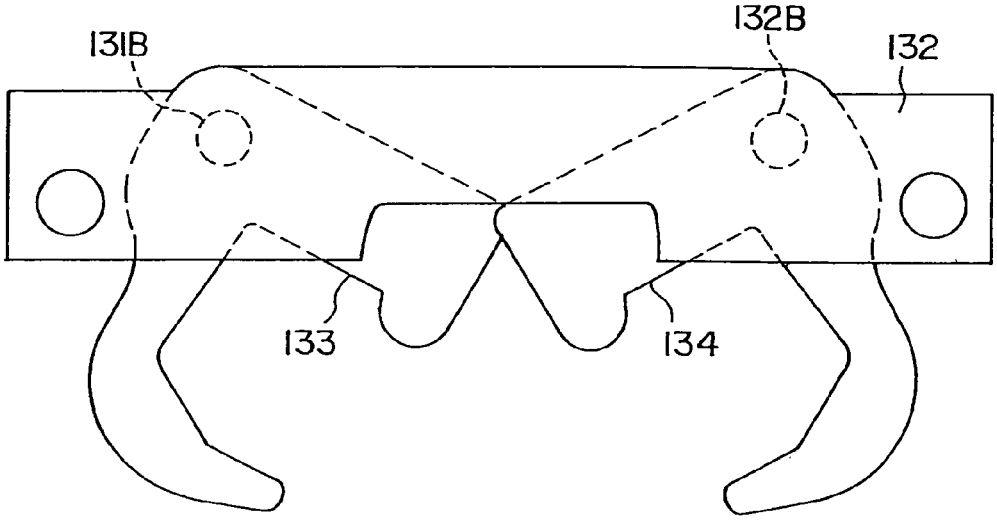
FIG. 6 is a side view of the holder attached with the clincher.

As shown in FIGS. 5 and 6, the holder 130 is structured by a pair of holder members 131 and 132 opposing to each other, and the holder member 131 and the holder member 132 are fixed mutually by a screw which is not shown. As shown in FIG. 3, pairs of guide surfaces 131*b* and 132*b*, which are slanted inwardly, are formed on upper surface portions 131A and 132A of the holder members 131 and 132, respectively. The pairs of guide surfaces 131*b* and 132*b* are adapted for guiding tips of legs of the staple inward.

Inner sides of the holder members 131 and 132 are formed with shaft portions 131B and 132B, respectively, and the clincher members 133 and 134 are rotatably mounted to each of the shaft portions 131B and 132B, respectively. The clincher members 133 and 134 are rotated around the shaft portions 131B and 132B as their respective centers in directions of arrows by elevation of the clincher arm 114 shown in FIG. 2, thereby clinching the legs of the staple (not shown) by the rotation. In addition, the two clincher members 133 and 134 structure a clincher.

Figure 7:
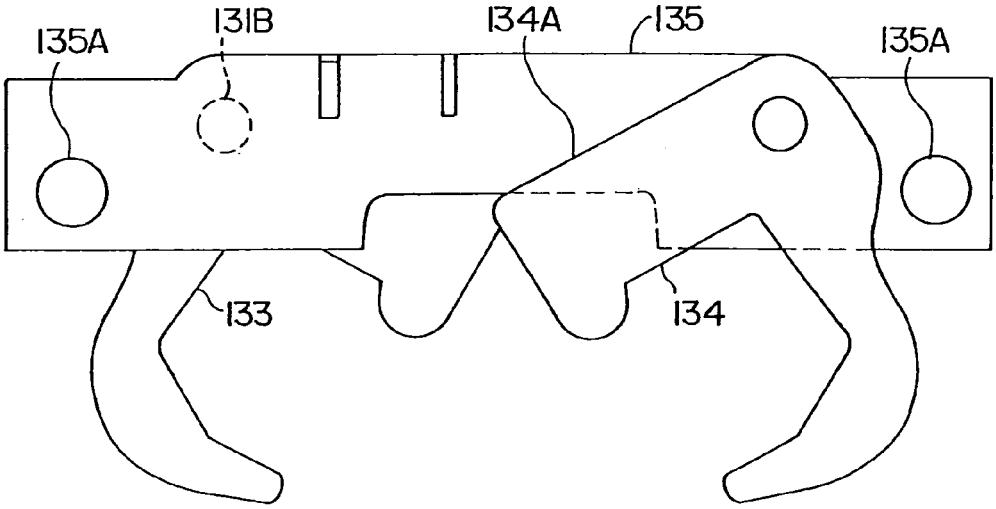
FIG. 7 is an explanatory view showing a partition plate.

A partition plate 135 shown in FIG. 7 is disposed between the clincher member 133 and the clincher member 134, so that the clincher members 133 and 134 may not interfere with each other when they are rotated. Thickness of the partition plate 135 is set to be thinner than that of the staple, and both ends of the partition plate 135 are provided with screw holes 135A and 135A, respectively.

In addition, as shown in FIG. 4, a straight line R1 connecting a center location P1 of a clinching surface 133A of the clincher member 133 as view in a thickness direction and a center location P2 of a clinching surface 134A of the clincher member 134 in a thickness direction, is slanted by approximately 6 degrees in relation to the straight line R2 in a direction along which the clinching surfaces 133A and 134A of the clincher members 133 and 134 extend (left and right directions in FIG. 4).

Wave springs 137 and 137, which are obtained by forming a plate spring in a wave-like shape, are disposed inside of the clincher unit box 111 between the walls 111A and 111B of the clincher unit box 111 and the holder 130, and the holder 130 is biased in directions of arrows by the wave springs 137 and 137 in such a manner as to press each other.

Next, operation of the stapler structured as described above will be explained.

When a not shown bundle of sheets is discharged from the copying machine (not shown) and a signal for binding is outputted from the copying machine, the motor 113 of the up-and-down mechanism 112 of the clincher unit 100 is driven and the clincher unit box 111 is elevated. By the elevation of the clincher unit box 111, the bundle of sheets is held between the driving out portion 21.

Further, when the clincher unit box 111 is elevated in the state that the bundle of sheets is sandwiched, the driver unit 11 is pushed up with respect to the outer frame 12, and the driver 70 of the driver unit 11 is lowered relative to the driver unit 11, thereby the staple (not shown) is driven out from the driving out portion 21.

As the legs of the driven-out staple penetrate the bundle of sheets, when a center axis of the driver deviates from the center locations P1 and P2 of the clincher members, the legs S1 of the staple having penetrated the bundle of sheets are brought into contact with the guide surfaces 131*b* of the holder member 131, for example, as shown in FIG. 3. Then, as the legs S1 are further pushed down by the driver 70, the holder 130 moves rightward (in FIG. 3) against the biasing force of the spring.

By the rightward movement of the holder 130, the positional deviation between the center axis of the driver and the center locations P1 and P2 of the clincher members 133 and 134 is corrected. Thereafter, the clincher arm 114 is elevated, and the clincher members 133 and 134 are rotated in the directions of the arrows around the shaft portions 131A and 132A as their respective centers to clinch the legs S1 of the staple. At the time of the clinching, because the positional deviation between the center axis of the driver and the center locations P1 and P2 of the clincher members 133 and 134 is corrected, the clinching can be carried out without failure, thus it is possible to avoid buckling of the legs S1 of the staple and defective clinching of the legs S1.

As described above, the holder 130 moves with respect to the clincher unit box 111. Because the positional deviation of the clincher members 133 and 134 is assimilated by the movement of the holder 130, it is possible to provide a correctly binded state constantly, without strictly carrying out positioning at the time of assembling of the clincher members 133 and 134.

Figure 8:
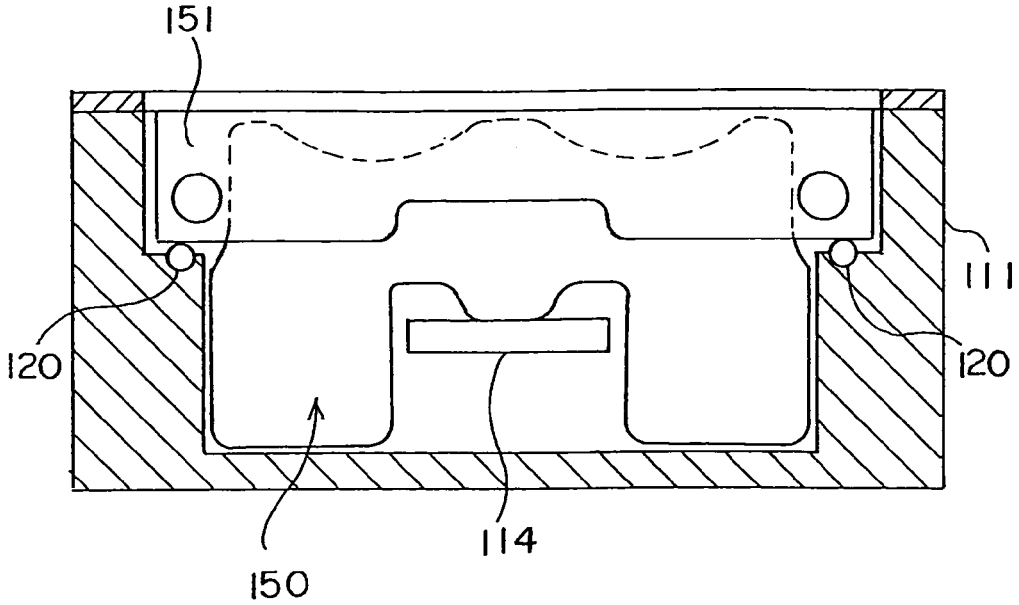
FIG. 8 is an explanatory view showing a clincher member which is another example.
Figure 9:
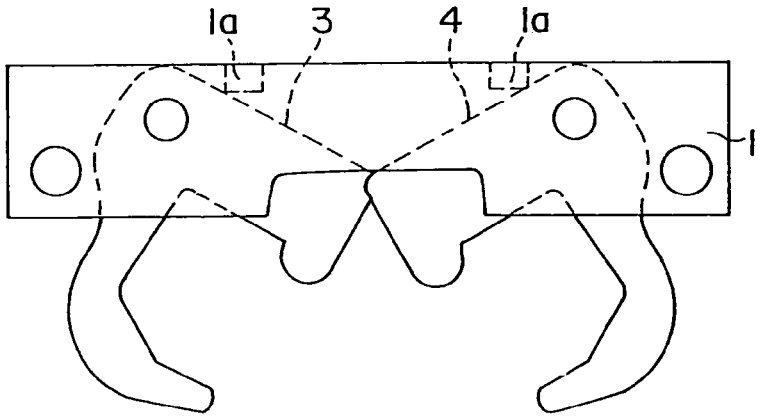
FIG. 9 (PRIOR ART)
FIG. 9 is an explanatory view showing a conventional clincher holder.
Figure 10:
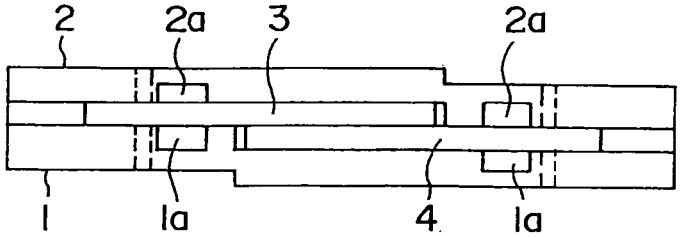
FIG. 10 (PRIOR ART)
FIG. 10 is a plain view showing the conventional clincher holder.
Figure 11:
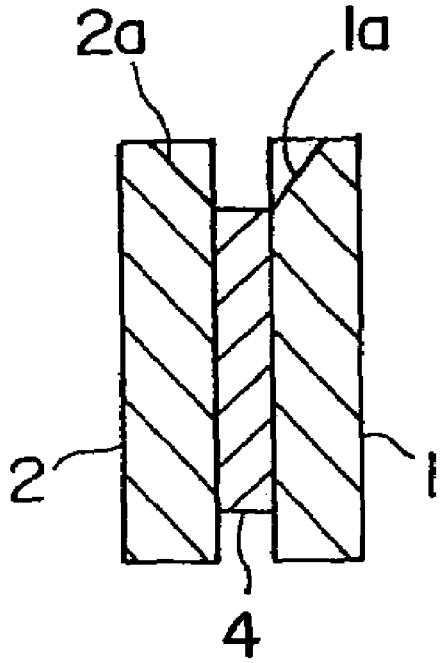
FIG. 11 (PRIOR ART)
FIG. 11 is a sectional view showing the conventional clincher holder.

FIG. 8 shows a clincher member 150 of another embodiment. The clincher member 150 is vertically movably held by a pair of holders 151, and the holders 151 are disposed movable in the clincher unit box 111 similarly to the holder 130. The clincher member 150 is configured that the clincher member 150 is moved up by the elevation of the clincher arm 114, thereby clinching the legs S1 of the staple.

As described in the foregoing, according to the present invention, it is possible to avoid the defective clinching of the staple and the buckling of the legs. In addition, because the positional deviation of the clincher members is assimilated by the movement of the holder, it is possible to provide the correctly binded state constantly, without strictly carrying out the positioning at the time of assembling of the clincher members.

INDUSTRIAL APPLICABILITY

In the above-described embodiment, it has been described a case where the present invention is applied to the separate type stapler. However, it may be recommendable to apply the present invention to an electric stapler in an integral-type or to a hand-operated stapler.

The invention claimed is:

1. A stapler, comprising:

a clincher unit comprising a clincher for clinching legs of a staple driven out by a driver, a holder which holds the clincher, and at least one biasing member for biasing the holder in the clincher unit, said holder being formed with guide surfaces which are slanted for guiding tips of the legs of said staple toward the clincher, wherein said holder is mounted in the clincher unit so as to be movable relative to the clincher unit in response to press contact between the guide surface and the leg of the staple against a biasing force of said at least one biasing member when the leg is guided along the guide surface.

2. The stapler according to claim 1, further comprising a driver unit comprising said driver, wherein the driver unit and said clincher unit are vertically separated from each other.

3. The stapler according to claim 2, wherein said clincher has a pair of clincher members disposed rotatably relative to said holder, and disposed so that positions of their rotating surfaces are deviated from each other, and a partition plate is disposed between the clincher members.

4. The stapler according to claim 3, wherein said clincher unit comprises a clincher unit box of which a side opposing the driver is opened, and said holder is disposed movably in the clincher unit box, and said at least one biasing member is disposed between the holder and the clincher unit box.

5. The stapler according to claim 4, wherein said at least one biasing member comprises at least two biasing members disposed between a first wall of the holder and a first wall of the clincher unit box opposing said first wall of the holder, and between a second wall of the holder and a second wall of the clincher unit box opposing said second wall of the holder, to bias said holder in directions pressing toward each other.

6. The stapler according to claim 5, wherein said biasing members are wave springs.

7. The stapler according to claim 2, wherein said clincher unit comprises a clincher unit box of which a side opposing the driver is opened, and said holder is disposed movably in the clincher unit box, and said at least one biasing member is disposed between the holder and the clincher unit box.

8. The stapler according to claim 7, wherein said at least one biasing member comprises at least two biasing members disposed between a first wall of the holder and a first wall of the clincher unit box opposing said first wall of the holder, and between a second wall of the holder and a second wall of the clincher unit box opposing said second wall of the holder, to bias said holder in directions pressing toward each other.

9. The stapler according to claim 8, wherein said biasing members are wave springs.

10. The stapler according to claim 1, wherein said clincher has a pair of clincher members disposed rotatably relative to said holder, and disposed so that positions of their rotating surfaces are deviated from each other, and a partition plate is disposed between the clincher members.

11. The stapler according to claim 10, wherein said clincher unit comprises a clincher unit box of which a side opposing the driver is opened, and said holder is disposed movably in the clincher unit box, and said at least one biasing member is disposed between the holder and the clincher unit box.

12. The stapler according to claim 11, wherein said at least one biasing member comprises at least two biasing members disposed between a first wall of the holder and a first wall of the clincher unit box opposing said first wall of the holder, and between a second wall of the holder and a second wall of the clincher unit box opposing said second wall of the holder, to bias said holder in directions pressing toward each other.

13. The stapler according to claim 12, wherein said biasing members are wave springs.

14. The stapler according to claim 1, wherein said clincher unit comprises a clincher unit box of which a side opposing the driver is opened, and said holder is disposed movably in the clincher unit box, and said at least one biasing member is disposed between the holder and the clincher unit box.

15. The stapler according to claim 14, wherein said at least one biasing member comprises at least two biasing members disposed between a first wall of the holder and a first wall of the clincher unit box opposing said first wall of the holder, and between a second wall of the holder and a second wall of the clincher unit box opposing said second wall of the holder, to bias said holder in directions pressing toward each other.

16. The stapler according to claim 2, wherein said clincher has a pair of clincher members disposed rotatably relative to said holder, and disposed so that positions of their rotating surfaces are deviated from each other, and a partition plate is disposed between the clincher members.

* * * * *